United States Patent [19]

Rosenfeld

[11] Patent Number: 4,936,481

[45] Date of Patent: Jun. 26, 1990

[54] DEVICE FOR THE DELIVERY OF FOOD ITEMS

[75] Inventor: Michael S. Rosenfeld, Kenwood, Calif.

[73] Assignee: Kenwood Productions, Inc., Kenwood, Calif.

[21] Appl. No.: 144,560

[22] Filed: Jan. 14, 1988

[51] Int. Cl.[5] ..... B65D 3/00

[52] U.S. Cl. ..... 220/23.86; 220/20

[58] Field of Search ..... 220/23.86, 23.83, 20, 220/22, 85 H; 206/217; 229/904, 1.5 H, 4.5

[56] References Cited

U.S. PATENT DOCUMENTS

| | | | |
|---|---|---|---|
| 1,595,356 | 8/1926 | Moseman | 220/22 X |
| 2,096,825 | 10/1937 | Roman | 220/20 X |
| 2,546,104 | 3/1951 | MacGregor | 220/20 X |
| 2,561,022 | 7/1951 | Jones | 220/20 X |
| 3,323,706 | 6/1967 | Gereke | 206/217 |
| 3,397,804 | 8/1968 | Davis | 220/20 |
| 3,887,069 | 6/1975 | Diwo | 220/23.86 X |
| 3,955,672 | 5/1976 | Brundage | 220/23.86 X |
| 4,491,220 | 1/1985 | Daviss | 229/1.5 H X |
| 4,534,474 | 8/1985 | Ng | 220/23.86 |
| 4,684,015 | 8/1987 | Vezirian | 220/20 X |

*Primary Examiner*—Steven M. Pollard

*Attorney, Agent, or Firm*—Spensley Horn Jubas & Lubitz

[57] ABSTRACT

A unitary device for the delivery of two or more food items. The device has a first container having a bottom and at least one side wall which defines a first partially enclosed area and a second container having at least one side wall which defines a second partially enclosed area. The second container is adapted to be partially received by an aperture defined by the bottom of the first container. A first food item is located within the first partially enclosed area and a second food item is located in the second container.

23 Claims, 1 Drawing Sheet

DEVICE FOR THE DELIVERY OF FOOD ITEMS

BACKGROUND OF THE INVENTION

1. Field of the Invention

The present invention relates to a device for the delivery of food items.

2. Related Art

In recent decades, people have, for a variety of reasons, seen a significant increase in the amount of leisure time available to them. As a result of this, there has been a corresponding increase in the options available in which to spend this increased leisure time.

For example, spectator sports such as baseball, basketball, football, and the like are attracting an ever increasing number of fans. The movie industry is producing and distributing a staggering number of motion pictures. As a corollary to this, attendance at such sporting events, movies, and the like is becoming more and more an integral part of peoples' lives.

Often, those in attendance at such functions will enhance the pleasure of their attendance by consuming food items while, for example, viewing a sporting event or movie. Examples of some of the favorite food items traditionally consumed while viewing a sporting event or movie include, popcorn, peanuts, nachos, potato chips and the like. As those who have eaten such food items will appreciate, it is often desirable to have a beverage available to consume with said food items.

In the past, food items, such as those described above have been supplied to a consumer in a container separate and distinct from the container in which a beverage is supplied. This results in several undesirable situations.

First, it is likely that two hands will be needed to transport the food item and beverage from the place of purchase to the place of viewing the sporting event, movie, or the like. Similarly, since a number of sport stadiums theatres and the like do not provide means for holding the food item and/or beverage while viewing an event, the person must attempt to hold the container of food, the container of beverage and also consume the two items. Often this requires placing the beverage container on the floor near one's seat; thus freeing one hand for other uses. Unfortunately, many beverage containers placed on the floor, as described above, have been spilled as a result of being inadvertently kicked or otherwise toppled. Moreover, even when the beverage container is not accidentally tipped, being forced to continually grasp the container from its location on the floor can be inconvenient.

Additionally, the beverage container is often fabricated from a material and in a way which requires the consumer to grasp and hold a cold, wet, slippery surface. Finally, the above facts often motivate two or more people to purchase a single container of one food item and a single beverage container with the intent of sharing both items. This sharing can lead to the transfer of germs and the like from one party to the other occassionally resulting in the transfer of an illness.

SUMMARY OF THE INVENTION

It is to the goal of avoiding the described situation that the present invention is directed. Specifically, the present invention is directed to a unitary device capable of delivering two food items, such as popcorn and a beverage, to a consumer in a manner which avoids the described problems.

These goals are achieved by a device comprising a first container having at least one side wall and a bottom which first container defines a first partially enclosed area. The bottom of the first container defines an aperture. The device further comprises a second container adapted to be partially received by the aperture defined by the bottom of the first container. The second container comprises at least one side wall and defines a second partially enclosed area received by the aperture, the second container extends into the first partially enclosed area defined by the first container.

In use, for example, in delivering popcorn and a beverage, one end of the second container is partially received by the aperture in the bottom of the first container such that a major portion of the second container is located within the first partially enclosed area. Popcorn is located in the first partially enclosed area but not within the second partially enclosed area. A beverage cup is located in the second container. Thus, both the popcorn and beverage are provided in a unitary device which is designed to be transported and held in position for consumption with one hand.

DETAILED DESCRIPTION OF THE INVENTION

The present invention relates to a unitary device adapted to hold, for serving, two separate food items. The present invention comprises a first container adapted to hold at least one food item and a second container adapted to hold a second food item. The first and second containers are adapted to be joined together.

Figure 1:
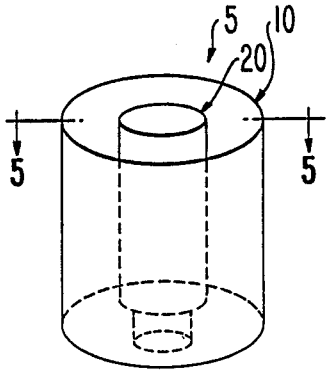
FIG. 1 illustrates a perspective view of one embodiment of a device according to the present invention.

Referring now to the figures, FIG. 1 illustrates a perspective view of one embodiment of a device 5 according to the present invention. The device 5 comprises a first container 10 and a second container 20 held in place by and located within the first container 10.

Figure 2:
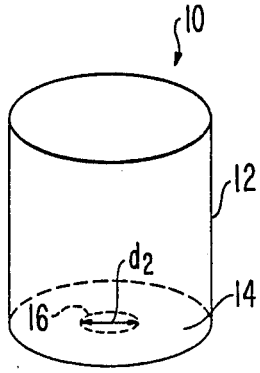
FIG. 2 illustrates a perspective view of a first container according to the present invention.

FIG. 2 illustrates a perspective view of a first container 10 of the present invention. The first container 10 comprises a side wall 12 and a bottom 14 attached to the side wall 12. Together, the side wall 12 and bottom 14 define a first partially enclosed area corresponding generally to the interior of the first container 10. The bottom 14 defines an aperture 16 adapted to partially receive the second container 20.

In the illustrated embodiment, first container 10 comprises a single generally circular side wall 12 thus defining a generally cylindrical first container. It is to be understood that the first container may comprise more than one side wall and may thus have a shape other than the illustrated generally cylindrical shape. For instance, when the first container comprises three or four identically dimensioned side walls, the first container defines a triangular prism or rectangular prism, respectively.

In the illustrated embodiment, bottom 14 is generally circular and adapted to seal one end of the cylinder defined by side wall 12. Naturally, if the first container comprises more than one side wall, the shape of bottom 14 may be altered. For instance, if the first container comprises three or four identically dimensioned side walls, the bottom may be generally triangular, square or rectangular in shape.

The aperture 16 adapted to partially receive the second container and defined by bottom 14 is illustrated as being generally circular in shape. It is to be understood that the aperture 16 may have any convenient shape (triangular, square, rectangular and the like) provided it be adapted to partially receive the second container.

Figure 3:
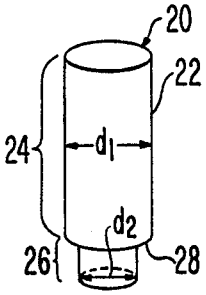
FIG. 3 illustrates a perspective view of one embodiment of a second container according to the present invention.

FIG. 3 illustrates a perspective view of one embodiment of a second container 20 according to the present invention. The second container 20 is illustrated as comprising a single side wall 22, thus providing the second container 20 with a generally cylindrical shape. The second container 20 defines a second partially enclosed area corresponding generally to the interior of the cylinder formed by side wall 22. The second container 20 is adapted to be partially received by aperture 16 of the first container 10.

In the embodiment illustrated in FIG. 3, second container 20 comprises a first section 24 adapted to be located within the first partially enclosed area of the first container 10 when the second container 20 is partially received by aperture 16 of the first container 10. The second container 20 comprises a second section 26 adapted to be received by aperture 16 when the second container 20 is partially received by the first container 10.

The first section 24 has a diameter $d_1$ and second section 26 has a diameter $d_2$. The diameter of the second section 26 corresponds generally to the diameter of aperture 16 to allow the second section 26 to be received by the aperture 16. The diameter $d_1$ of first section 24 is generally greater than diameter $d_2$ of the second section 26. Thus, the first section 24 cannot be received by the aperture 16. The interface of the first section 24 and the second section 26 defines a lip area 28 adapted to impinge upon the bottom 14 in the general area of aperture 16 when the second container 20 is received by the aperture 16 of the first container 10.

In operation, the second section 26 is adapted to pass through aperture 16 while first section 24 has a diameter $d_1$ which is too great to allow the first section 24 to pass through the aperture 16. Therefore, lip area 28 of the second container 20 impinges upon bottom 14 in the general area of aperture 16. Thus, the second container 20 is partially received by the aperture 16, but prevented from passing entirely through aperture 16.

Figure 4:
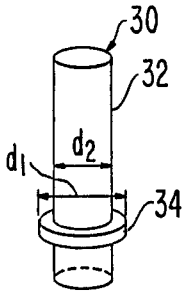
FIG. 4 illustrates a perspective view of a second embodiment of a second container according to the present invention.

FIG. 4 illustrates a second embodiment of a second container 30 of the present invention. The second container 30 comprises a single side wall 32 defining a generally cylindrical sleeve. Second container 30 has a diameter $d_2$ which generally corresponds to the diameter of the aperture 16 defined by the bottom 14 of the first container 10. The second container 30 comprises restraining means 34 adapted to prevent the second container 30 from passing entirely through the aperture 16 when the second container 30 is partially received by the first container 10. Any means for so restraining second container 30 is suitable for use in the present invention. In the illustrated embodiment, the restraining means 34 functions to provide a portion of the second container 30 with an outer diameter greater than the diameter of the aperture 16. Specifically, the restraining means 34 comprises a restraining ring formed about the circumference of the second container 30 and integrally attached to the side wall 32. It is understood that alternative means are within the scope of the present invention. Exemplary alternative restraining means for use in the present invention include a threaded portion on the second container 30 adapted to allow the second container to be screwed into the aperture 16. Also acceptable for use as a restraining means would be a groove defined by the second container 30 and adapted to receive an edge defined by the aperture 16.

In operation, the second container 30 is received by first container 10 by having a portion 36 of the second container 30 pass through the aperture 16. The portion 26 of the second container 30 passes through the aperture 16 until a lip area 28 defined by restraining means 34 contacts the bottom 14 of the first container 10.

Figure 5:
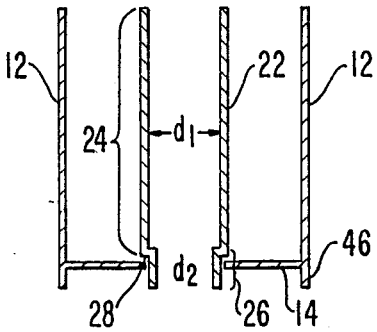
FIG. 5 illustrates the planar, cross-sectional view of the device of FIG. 1 taken along line 5—5 of FIG. 1.

FIG. 5 represents a planar, cross-sectional view of the device of FIG. 1 taken along line 5—5 of FIG. 1. As can be appreciated from FIG. 5, the second section 26 of the second container 20 passes through the aperture 16 until the lip area 28 rests upon the bottom 14 of the first container 10. A length of the second section 26 will extend beyond the bottom 14. Therefore, in order to allow for the placement of the device of the present invention upon a flat surface without forcing the second container 20 to move out of a partially received relationship with the first container 10, it is often desirable for a portion of the side wall 12 to extend past the point where the bottom 14 attaches to the side wall 12. The portion of side wall 12 extending beyond the point where the bottom 14 attaches to the side wall 12 is illustrated as support portion 46. Thus, when the container of the present invention is set on a flat surface, the device will rest on support portion 46.

Those skilled in the art will recognize that the first and second containers can be made out of a variety of materials. Any material possessing the structural integrity necessary to allow the device of the present invention to function in the described manner is suitable for use in the present invention. For example, the first and second containers can be fabricated from a paper stock material, a variety of thermoplastic or thermosetting resinous materials (e.g., polyethylene, polypropylene, styrene, etc.) and the like. If the first or second container is to be fabricated from a paper stock material, it may, depending on the food items to be contained within the device, be desirable to coat the paper stock material with a protective coating. For example, if a moist food item is to be contained by one of the containers, it may be desirable to coat the paper stock material with a wax or resinous material in order to prevent moisture from the food item from deteriorating the strength of the paper stock material. The first container and second container may be formed from the same or different materials.

Any means suitable for attaching the bottom 14 to the side wall 12 of the first container is suitable for use in the present invention. The method of attachment will vary depending on the material from which the first container is fabricated. For example, if the first container is fabricated from a resinous material through an injection molding process, the bottom 14 may be integrally formed with the side wall 12. Alternatively, if the first container 10 is to be fabricated from a paper stock material, bottom 14 may be glued to side wall 12. In some instances, it may be desirable to provide a reinforcing material around the aperture 16 defined by the bottom 14. Again, this depends on the material from which the bottom 14 is fabricated. Those skilled in the art will recognize means of forming such a reinforced area.

In one use, the device of the present invention is designed to serve popcorn and a beverage to, for example, theatre patrons. In this use, the first container 10 and the second container 20 are provided separately to food service personnel. The food server places the second container in a partially received relationship within the first container to form a device according to the present invention. Popcorn is then scooped into the device. Popcorn located within the first partially enclosed area but outside of the second partially enclosed area is retained within the first partially enclosed area. Popcorn located within the second partially enclosed area passes through the second container due to its hollow nature and is returned to a popcorn storage area. A beverage cup is then placed and held for consumption within the second container.

Figure 6:
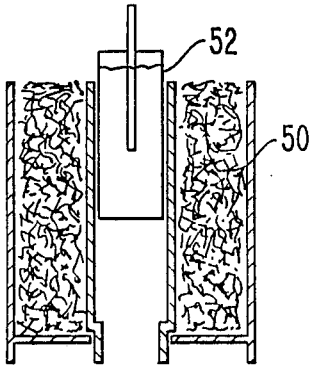
FIG. 6 illustrates a planar, cross-sectional view of the device of FIG. 5 in use for the delivery of food items.

FIG. 6 illustrates a cross-section of the device of FIGS. 1 and 5 in use to hold and serve popcorn 50 and beverage cup 52. Those skilled in the art will recognize that numerous methods are suitable for use to keep beverage cup 52 in a desired location within the second container 20. For example, beverage cup 52 may be tapered so that beverage cup 52 cannot pass entirely through the second container, but is instead restrained thereby. Alternatively, beverage cup 52 may comprise a lip adapted to impinge upon the second container and thereby prevent beverage cup 52 from passing entirely through the second container. Any method of maintaining beverage cup 52 in a desirable location is suitable for use with the present invention.

Those skilled in the art will recognize that numerous modifications can be made to the device described above without departing from the spirit or scope of the present invention. It is to be understood that the above description is not intended to limit, in any manner, the scope of the invention as set forth in the following claims.

What is claimed is:

1. A device for the delivery of food items, the device comprising:

a first container comprising:

at least one side wall defining a first plurality enclosed area; and a bottom attached to the side wall, said bottom defining an aperture; and a second container comprising at least one side wall defining a second partially enclosed area said second container being adapted to receive and support a beverage container and to be at least partially received by said aperture.

2. The device of claim 1 wherein the first and second containers are generally cylindrical in shape.

3. The device of claim 1 wherein the second container comprises a first section having a diameter greater than a diameter of said aperture and a second section having a diameter generally equal to the diameter of said aperture.

4. The device of claim 3 wherein said first and second sections define a lip area adapted to impinge on said bottom when the second section is received by the aperture.

5. The device of claim 1 wherein the second container comprises a side wall defining a cylinder having a diameter generally equal to a diameter of the aperture and further comprising means for restraining the second container from being totally received by the aperture.

6. The device of claim 5 wherein the restraining means comprises a restraining ring integrally attached to the side wall and having an outer diameter greater than the diameter of the aperture.

7. A device for the delivery of food items, the device comprising:

a first generally cylindrical container comprising:

one side wall defining a first partially enclosed area and a generally circular bottom attached to the side wall said bottom defining a generally circular aperture having a diameter; and a second generally cylindrical container comprising one side wall defining a second partially enclosed area, said second container being adapted to receive and support a beverage container and to be at least partially received by said aperture.

8. The device of claim 7 wherein the second container defines a first section having a diameter generally greater than the diameter of the aperture and a second section having a diameter generally equal to the diameter of the aperture.

9. The device of claim 7 further comprising means for restraining the second container from being totally received by the aperture.

10. The device of claim 9 wherein the restraining means comprises a restraining ring integrally attached to the side wall of the second container and having an outer diameter greater than the diameter of the aperture.

11. A method for the delivery of food items, the method comprising:

providing a first container comprising:

at least one side wall defining a first partially enclosed area and a bottom attached to the side wall said bottom defining an aperture;

providing a second container comprising at least one side wall defining a second partially enclosed area, said second container being adapted to receive and support a beverage container and to be at least partially received by said aperture;

placing the second container within a partially received relationship with the first container; and placing a first food item within the first container and a beverage container within the second container.

12. The method of claim 11 wherein at least a portion of the second container is located within the first partially enclosed area.

13. The method of claim 12 wherein the food item contained within the first container is popcorn.

14. A device for the delivery of food items, the device comprising:

a bottom defining an aperture;

at least one outer side wall attached to said bottom, said outer side wall and bottom defining a first partially enclosed area in the form of an uninterrupted annulus;

at least one inner side wall attached to the bottom along a circumference of the aperture, said inner side wall having a top edge and defining a second partially enclosed area wherein the second partially enclosed area is at least partially located within the first partially enclosed area; and a beverage container having a height not greater than the height of said second partially enclosed area, said beverage container being received in said second partially enclosed area and being supported by said top edge of said inner side wall.

15. The device of claim 14 wherein the aperture defines a diameter which diameter is greater than a diameter defined by the at least one inner side wall.

16. The device of claim 14 wherein the first partially enclosed area is generally cylindrical in shape.

17. The device of claim 14 wherein the second partially enclosed area is generally cylindrical in shape.

18. The device of claim 16 wherein the second partially enclosed area is generally cylindrical in shape.

19. The device of claim 14 wherein the at least one inner side wall defines a first diameter and a second diameter, said first and second diameters being unequal.

20. The method of claim 11 wherein the at least one side wall of the first and second containers is continuous.

21. The device of claim 7 wherein the at least one side wall of the first and second containers is continuous.

22. The device of claim 1 wherein the at least one side wall of the first and second containers is continuous.

23. A method for the delivery of food items, the method comprising:

providing a container comprising:

a bottom defining an aperture;

at least one outer side wall attached to said bottom, said outer side wall and bottom defining a first partially enclosed area in the form of an uninterrupted annulus, and at least one inner side wall attached to the bottom along a circumference of the aperture, said inner side wall having a top edge and defining a second partially enclosed area, wherein said second partially enclosed area is adapted to receive and support a beverage container;

placing a first food item within the first partially enclosed area; and placing a beverage container within the second partially enclosed area so that the beverage container is supported by the top edge of the inner side wall, the beverage container having a height which is no greater than the height of the second partially enclosed area.

* * * * *